US011235789B2

(12) United States Patent
Fiquet et al.

(10) Patent No.: US 11,235,789 B2
(45) Date of Patent: Feb. 1, 2022

(54) TRAIN CONTROL SYSTEM AND TRAIN CONTROL METHOD INCLUDING VIRTUAL TRAIN STOP

(71) Applicant: Siemens Mobility, Inc., New York, NY (US)

(72) Inventors: Bruno Fiquet, Hoboken, NJ (US); William Conis, Manhasset, NY (US)

(73) Assignee: Siemens Mobility, Inc., New York, NY (US)

( * ) Notice: Subject to any disclaimer, the term of this patent is extended or adjusted under 35 U.S.C. 154(b) by 332 days.

(21) Appl. No.: 16/516,456

(22) Filed: Jul. 19, 2019

(65) Prior Publication Data

US 2021/0016812 A1 Jan. 21, 2021

(51) Int. Cl.
*B61L 27/00* (2006.01)
*B61L 3/00* (2006.01)

(52) U.S. Cl.
CPC ..... *B61L 27/0038* (2013.01); *B61L 3/006* (2013.01); *B61L 2027/005* (2013.01)

(58) Field of Classification Search
CPC ..... B61L 27/00; B61L 27/0038; B61L 15/00; B61L 3/12; B61L 3/00; B61L 3/006; B61L 2027/005
See application file for complete search history.

(56) References Cited

U.S. PATENT DOCUMENTS 8,812,227 B2 * 8/2014 Carlson ..... B61L 23/34 701/301
9,043,131 B2 5/2015 Carlson et al.
9,731,738 B2 8/2017 Carlson et al.
10,179,595 B2 * 1/2019 Carlson ..... B61L 15/0027
2012/0217350 A1 * 8/2012 Ghaly ..... B61L 19/06 246/27
2015/0060608 A1 * 3/2015 Carlson ..... B61L 27/0077 246/122 R
2017/0282944 A1 * 10/2017 Carlson ..... B61L 25/021
2018/0301012 A1 * 10/2018 Carlson ..... G08B 21/02
2018/0362058 A1 12/2018 Carlson et al.
2019/0054942 A1 * 2/2019 Carlson ..... H04W 4/44
(Continued)

FOREIGN PATENT DOCUMENTS

CA 2156026 A1 2/1996
EP 3441281 A2 2/2019

OTHER PUBLICATIONS

PCT International Search Report and Written Opinion of International Searching Authority dated Jul. 16, 2020 corresponding to PCT International Application No. PCT/US2020/031304 filed May 4, 2020.

*Primary Examiner* — Jason C Smith

(57) ABSTRACT

A train control system includes an onboard equipment with a wireless receiver and connected to a railway vehicle, a wayside equipment with a wireless transmitter and assigned to an interlocking entry point, wherein the interlocking entry point includes a home signal, wherein the wayside equipment is configured to wirelessly transmit status data of the home signal to the onboard equipment of the railway vehicle when approaching the interlocking entry point via a wireless communication link, and wherein the onboard equipment is configured to receive the status data of the home signal via the wireless communication link and to determine a distance between the railway vehicle and the interlocking entry point.

20 Claims, 4 Drawing Sheets

(56) References Cited

U.S. PATENT DOCUMENTS

| | | | | |
|---|---|---|---|---|
| 2019/0071106 | A1* | 3/2019 | Carlson | B61L 25/025 |
| 2021/0016812 | A1* | 1/2021 | Fiquet | B61L 27/0005 |
| 2021/0221408 | A1* | 7/2021 | Zhang | B61L 21/04 |
| 2021/0237784 | A1* | 8/2021 | Fiquet | B61L 3/126 |
| 2021/0237787 | A1* | 8/2021 | Fiquet | B61L 25/025 |

* cited by examiner

TRAIN CONTROL SYSTEM AND TRAIN CONTROL METHOD INCLUDING VIRTUAL TRAIN STOP

BACKGROUND

1. Field

Aspects of the present disclosure generally relate to the technical field of train control systems and methods, and more specifically to a virtual train stop for mass transit rail systems. The control system and control method relate to railway vehicles, also referred to as simply trains, such as for example work trains, streetcars, light rail vehicles, automatic (airport) shuttles, metros, subway trains, commuter trains, EMUS (Electric Multiple Units), DMUs (Diesel Multiple Unit), and high-speed trains etc.

2. Description of the Related Art

A traditional train stop, also known as trip stop, is a train protection device that automatically stops a train if the train attempts to pass a signal when the signal aspect and operating rules prohibit such movement, or, in some applications, if the train attempts to pass at an excessive speed. For example, the train stop automatically stops a train that runs through a red signal.

Traditional train stops include two basic components. One component is a trip arm mechanism, mounted on the ground adjacent to a rail, and the other component is a train-mounted trip cock which is connected either directly or electrically to a braking system of the train. Such mechanical train stops require complex circuitry and design, significant installation and maintenance effort, while lowering overall reliability of the system.

The described traditional (mechanical) train stops are no longer required with modern train control systems, such as for example Communication Based Train Control, referred to as CBTC. However, not all railway vehicles are equipped with CBTC. Thus, there may be a need to provide an improved train stop without the complex and maintenance intensive components of the known (mechanical) train stops.

SUMMARY

A first aspect of the present disclosure provides a train control system comprising an onboard equipment connected to a railway vehicle and comprising a wireless receiver; a wayside equipment comprising a wireless transmitter and assigned to an interlocking entry point; wherein the interlocking entry point comprises a home signal, wherein the wayside equipment is configured to wirelessly transmit status data of the home signal to the onboard equipment of the railway vehicle when approaching the interlocking entry point via a wireless communication link, and wherein the onboard equipment is configured to receive the status data of the home signal via the wireless communication link and to determine a distance between the railway vehicle and the interlocking entry point.

A second aspect of the present disclosure provides a train control method comprising wirelessly transmitting, by a railway wayside equipment, status data of a home signal at an interlocking entry point to an onboard equipment of a railway vehicle when the railway vehicle approaches the interlocking entry point; wirelessly receiving, by the onboard equipment, the status data of the home signal; and determining, by the onboard equipment, a distance between the railway vehicle and the interlocking entry point.

DETAILED DESCRIPTION

To facilitate an understanding of embodiments, principles, and features of the present disclosure, they are explained hereinafter with reference to implementation in illustrative embodiments. In particular, they are described in the context of being train control systems and train control methods including virtual train stops, for example for mass transit rail systems. Embodiments of the present disclosure, however, are not limited to use in the described systems or methods.

The components and materials described hereinafter as making up the various embodiments are intended to be illustrative and not restrictive. Many suitable components and materials that would perform the same or a similar function as the materials described herein are intended to be embraced within the scope of embodiments of the present disclosure.

Figure 1:
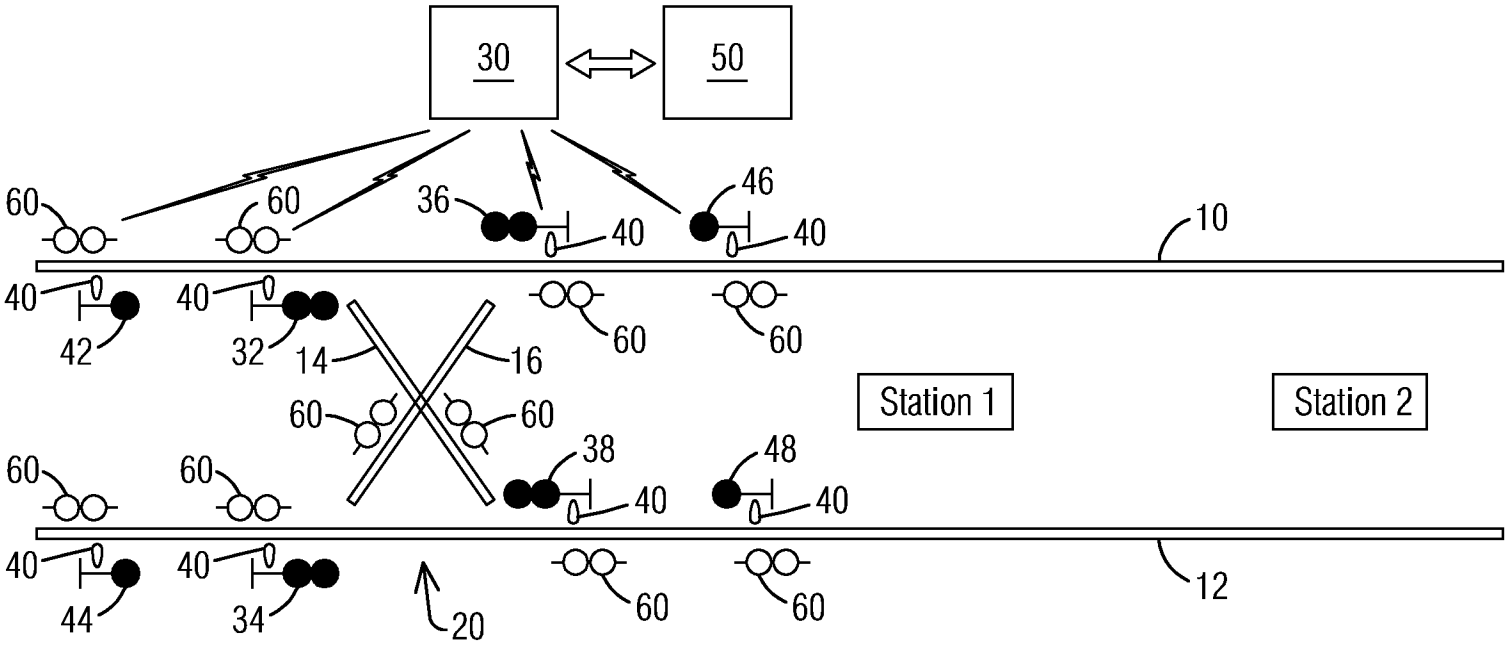
FIG. 1 (PRIOR ART)
FIG. 1 depicts a known signal arrangement diagram and train control system in accordance with embodiments of the present disclosure.

FIG. 1 illustrates a signal arrangement diagram. Signal arrangement diagram illustrates railway tracks 10 and 12 and a crossover 20, also known as diamond crossover. Railway track sections 14 and 16 form the crossover 20 and connect the railway tracks 10 and 12. Further, railway station 1 and station 2 are illustrated where trains stop to load or unload passengers or freight.

The signal arrangement diagram further illustrates interlocking 30 which controls railway traffic, i.e. movement of railway vehicles travelling on the tracks 10, 12, 14 and 16, utilizing interlocking signal equipment. Such signal equipment includes for example home signals 32, 34, 36, 38, approach signals 42, 44, 46, 48, switch machines (not illustrated), and train stops, also known as trip stops, 40. Each home signal 32, 34, 36, 38 and each approach signal 42, 44, 46, 48 is assigned or equipped with a train stop 40. The interlocking 30 is communicatively coupled and/or assigned to each home signal 32, 34, 36, 38, approach signal 42, 44, 46, 48 and each train stop 40 to control railway traffic.

Each train stop 40 is configured to automatically stop a train if the train attempts to pass a signal when the signal aspect and operating rules prohibit such movement, or, in some applications, if the train attempts to pass at an excessive speed. For example, the train stop 40 automatically stops a train that runs through a red signal.

The interlocking 30 can be configured as Solid State Interlocking (SSI) or as relay-based interlocking. Relay-based interlockings utilize electrical circuits wired through electro-magnetic relay contacts and coils. Solid State Interlockings, a.k.a. Electronic Interlockings, are well known, and have evolved from the relay-based interlockings that are widely used at various railroads, and transit properties around the world. Typically, a solid-state interlocking consists of a centralized vital processor that controls a plurality of signal peripherals, including signal aspects, track switch machines, automatic trip stop devices, and the like.

The interlocking 30 is communicatively coupled to a Communication Based Train Control (CBTC) zone controller 50, wherein interlocking 30 and CBTC zone controller 50 are adapted to exchange data and/or information. In order to perform CBTC, railway vehicles need to be equipped with CBTC functionality. A CBTC equipped railway vehicle may override a train stop 40 by forcing the train stop 40 in a permissive state, because the CBTC equipped railway vehicle is in communication with the CBTC zone controller 50 that provides the relevant information with respect to home signals 32, 34, 36, 38 and approach signals 42, 44, 46, 48.

In general, CBTC is a railway signaling system utilizing telecommunications between a train and track equipment for traffic management and infrastructure control. By means of the CBTC systems, exact positions of trains are known, more accurately than with traditional signaling systems, which results in a more efficient and safe way to manage railway traffic. Further details with respect to CBTC are not described herein as one of ordinary skill in the art is familiar with CBTC.

FIG. 1 further illustrates multiple axle counter systems 60. An axle counter system 60 typically comprises a wheel sensing system with trackside connection box and evaluation module. In general, axle counter systems 60 detect a passing of a railway vehicle travelling on the railroad track 10, 12, 14 and 16 between two points. In other words, axle counter systems 60 are used for track vacancy detection—determining if a section of track 10, 12, 14, 16 is currently occupied by a train or other equipment by counting axles into and out of a section block. In addition to detecting the railway vehicle, the systems 60 may provide values or signals, such as for example travelling direction and/or speed data of the railway vehicle. Instead of axle counter systems, track circuits can be used to detect presence or absence of a train on the railroad tracks. Track circuits utilize electrical circuits, wherein the basic principle lies in a connection of the rails by wheels of locomotives and rolling stock to short out an electrical circuit. Track circuits are well known and will not be described in further detail herein.

Figure 2:
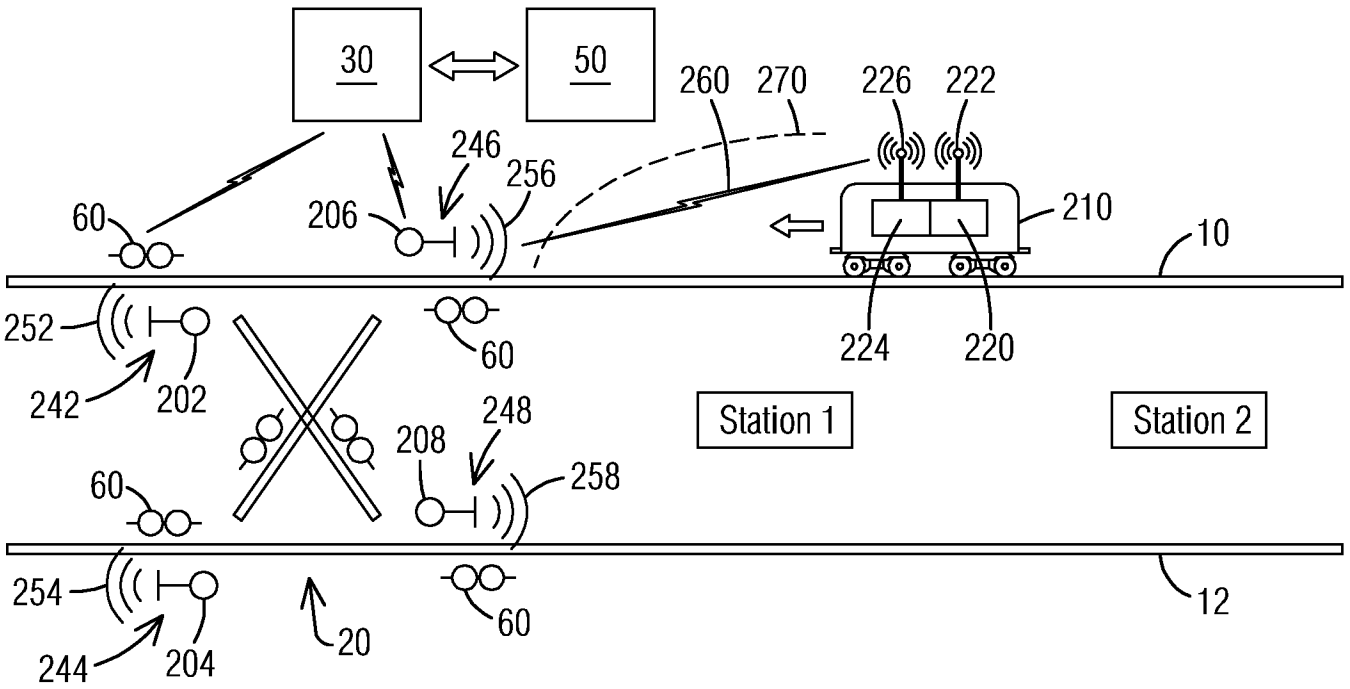
FIG. 2 depicts a signal arrangement diagram and train control system with virtual train stop in accordance with an exemplary embodiment of the present disclosure.

FIG. 2 depicts a signal arrangement diagram with train control system 200 including virtual train stop(s). Signal arrangement diagram illustrates railway tracks 10 and 12 and diamond crossover 20. Railway track sections 14 and 16 form the crossover 20 and connect the railway tracks 10 and 12. Further, railway station 1 and station 2 are illustrated where trains stop to load or unload passengers or freight.

The signal arrangement diagram further illustrates interlocking 30 which controls railway traffic, i.e. movement of railway vehicles travelling on the tracks 10, 12, 14 and 16, utilizing interlocking signal equipment. Interlocking 30, configured for example as Solid State Interlocking or relay-based Interlocking, interfaces with signal equipment including home signals 202, 204, 206 and 208, located at entry points of the interlocking 30. The interlocking 30 and home signals 202, 204, 206, 208 are communicatively coupled to each other. Interlocking 30 and Communication Based Train Control (CBTC) zone controller 50 are adapted to exchange data and/or information to each other for train control purposes.

FIG. 2 further illustrates railway vehicle 210 which may or may not be equipped with CBTC functionality. In the example of FIG. 2, railway vehicle 210 is not CBTC equipped, which means that the vehicle 210 does not receive relevant information, for example with respect to home signals 202, 204, 206, 208, from the CBTC zone controller 50.

As previously noted, the traditional (mechanical) train stops 40, see FIG. 1, require complex circuitry and design, significant installation and maintenance effort, while lowering overall reliability of the system.

The train control system 200 provides a virtual train stop which eliminates the need for traditional train stops. The train control system 200 comprises an onboard equipment 220 connected to railway vehicle 210 and comprising a wireless receiver 222. The onboard equipment 220 may also be referred to as mobile beacon. The onboard equipment 220 with receiver 222 is carried by or mounted to the railway vehicle 210.

The train control system further comprises wayside equipment 242, 244, 246, 248 comprising wireless transmitter(s) 252, 254, 256, 258, the wayside equipment 242, 244, 246, 248 being assigned and/or operably coupled to an interlocking entry point, e.g., home signals 202, 204, 206, 208. Specifically, wayside equipment 242 is assigned to home signal 202, wayside equipment 244 is assigned to home signal 204, wayside equipment 246 is assigned to home signal 206 and wayside equipment 248 is assigned to home signal 208.

Further, the onboard equipment 220 and the wayside equipment 242, 244, 246, 248 are adapted to communicate via a wireless communication link 260 to transmit data, for example signal data relating to the home signals 202, 204, 206, 208.

The wayside equipment 242, 244, 246, 248 is configured to wirelessly transmit status data of the home signal 202, 204, 206, 208 to the onboard equipment 220 of the railway vehicle 210, specifically when the railway vehicle 210 approaches the interlocking entry point(s), e.g. home signals 202, 204, 206, 208. The onboard equipment 220, via receiver 222, utilizing the communication link 260, is configured to wirelessly receive the status data of the home signal 202, 204, 206, 208, and to determine a distance (ranging) between the railway vehicle 210 and the respective interlocking entry point(s), e.g. home signal(s) 202, 204, 206, 208.

In an example, see FIG. 2, the railway vehicle 210 approaches home signal 206 of crossover 20. The wayside equipment 246, via transmitter 256, transmits (broadcasts) the status data of the home signal 206. As soon as the railway vehicle 210 is in range, the onboard equipment 220, via receiver 222, receives the status data of the home signal 206.

The onboard equipment 220 is further configured to automatically activate a braking system of the railway vehicle 210 when the home signal comprises a stop signal, i.e. red signal, and a distance between the railway vehicle 210 and the respective interlocking entry point(s), i.e. home signal(s), essentially corresponds to or is less than a braking distance required for a stop of the railway vehicle 210. This feature is depicted by braking curve 270, which illustrates the train 210 having to slow down and stop before the interlocking entry point, e.g. home signal 206. This provides safety of railway traffic because the railway vehicle 210 is automatically stopped when a stop signal (red signal) is detected/received by the onboard equipment 220, which then activates the braking system of the vehicle 210. Activating the braking system of the vehicle 210 may include activating full service brake and/or emergency brake of the vehicle 210.

In case the onboard equipment 220 is not connected or cannot access the braking system of the vehicle 210, the onboard equipment 220 can be configured to automatically provide a (warning) message to an operator of the railway vehicle 210 to activate the braking system. The operator of the railway vehicle 210 can then active one or more braking components based on the generated warning message.

In another embodiment, even if the onboard equipment 220 is configured to activate the braking system of the vehicle 210, the onboard equipment 220 may still generate a message to the operator of the vehicle 210 that the braking system has been activated due to certain requirements/thresholds that have been met (red signal and distance between railway vehicle 210 and home signal 206).

In another embodiment, the railway vehicle 210 may comprise first onboard equipment 220 with wireless receiver 222 and second onboard equipment 224 with wireless receiver 226, for example for redundancy and safety purposes. The first and second onboard equipment 220, 224 are each configured to receive the status data of the home signal 202, 204, 206, 208 and to perform functionalities and processes are described herein.

In an embodiment, the wayside equipment 242, 244, 246, 248 is integrated into a signal head (not illustrated) of the home signal 202, 204, 206, 208. Each home signal 202, 204, 206, 208 is embodied as a signal head or signal device arranged along the tracks 10, 12. Integrating the wayside equipment 242, 244, 246, 248 into signal heads provides easy installation and utilized existing equipment. Further, the wayside equipment 242, 244, 246, 248 may be easily coupled (electrically/electronically) to the home signal 202, 204, 206, 208 for providing signal data. In an alternative, the wayside equipment 242, 244, 246, 248 is a separate component and arranged/located outside a signal head of a home signal, but nearby or close to the home signal, i.e. interlocking entry point, to provide accurate ranging for the onboard equipment 220, 224.

In an embodiment, the communication link 260 comprises ultra-wide band (UWB). UWB is a radio technology that can use a very low energy level for short-range. The status/signal data of the home signal 202, 204, 206, 208 is used as a reference point for ranging by the onboard equipment 220, e.g., UWB mobile beacon. Ranging means that the UWB mobile beacon determines the distance separating the train 210 from the wayside equipment 242, 244, 246, 248 (interlocking entry point). For example, ranging can be performed over a fairly long distance (up to 2000 feet), wherein communication comprises low bandwidth (up to 16 kb/s). In other embodiments, the communication link 260 may not utilize UWB, but other wireless communication technologies, such as for example wireless LAN (over Internet access point) or cellular/mobile network.

Figure 3:
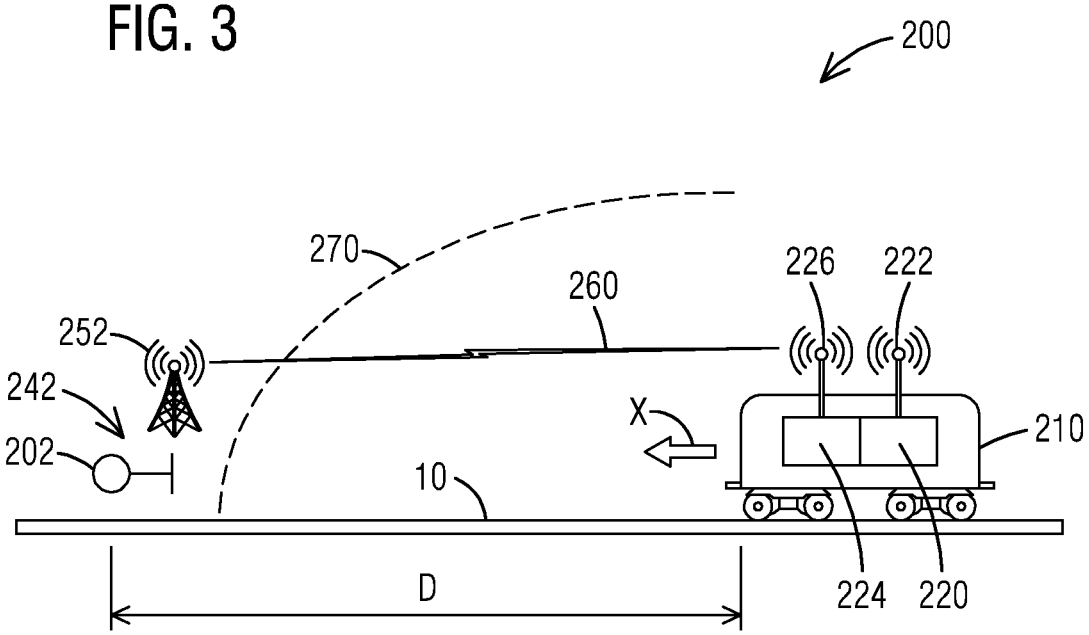
FIG. 3 depicts a schematic of a train control system with virtual train stop in accordance with an exemplary embodiment of the present disclosure.

FIG. 3 depicts an enlarged section of the schematic train control system 200 with virtual train stop illustrated in FIG. 2, wherein same reference numerals label same or similar components.

Railway vehicle 210 travels along track 10 in direction indicated by arrow X. Railway vehicle 210 comprises onboard equipment 220, 224, configured for example as UWB mobile beacons. Each onboard equipment 220, 224 comprises a wireless receiver 222, 226, configured as UWB wireless receiver. Further, home signal 202 is assigned or equipped with a wayside equipment 242, configured for example as UWB wayside anchor, and comprising a UWB wireless transmitter 252. When the vehicle 210 approaches the home signal 202, typically located at an interlocking entry point, the wireless receivers 222, 226 receive status data of the home signal 202, broadcasted or transmitted by the UWB wayside anchor 242 via the UWB link 260. If the onboard equipment 220, 224 is configured to activate the braking system of the vehicle 210, the onboard equipment 220, 224 will activate the braking system when the home signal 202 displays or provides a stop signal (red signal) for the vehicle 210, and when a distance D between the vehicle 210 and the home signal 202 essentially corresponds or is less than a braking distance of the vehicle 210 required for a (full) stop of the vehicle 210. In this example, the railway vehicle 210 does not comprise CBTC functionality.

Figure 4:
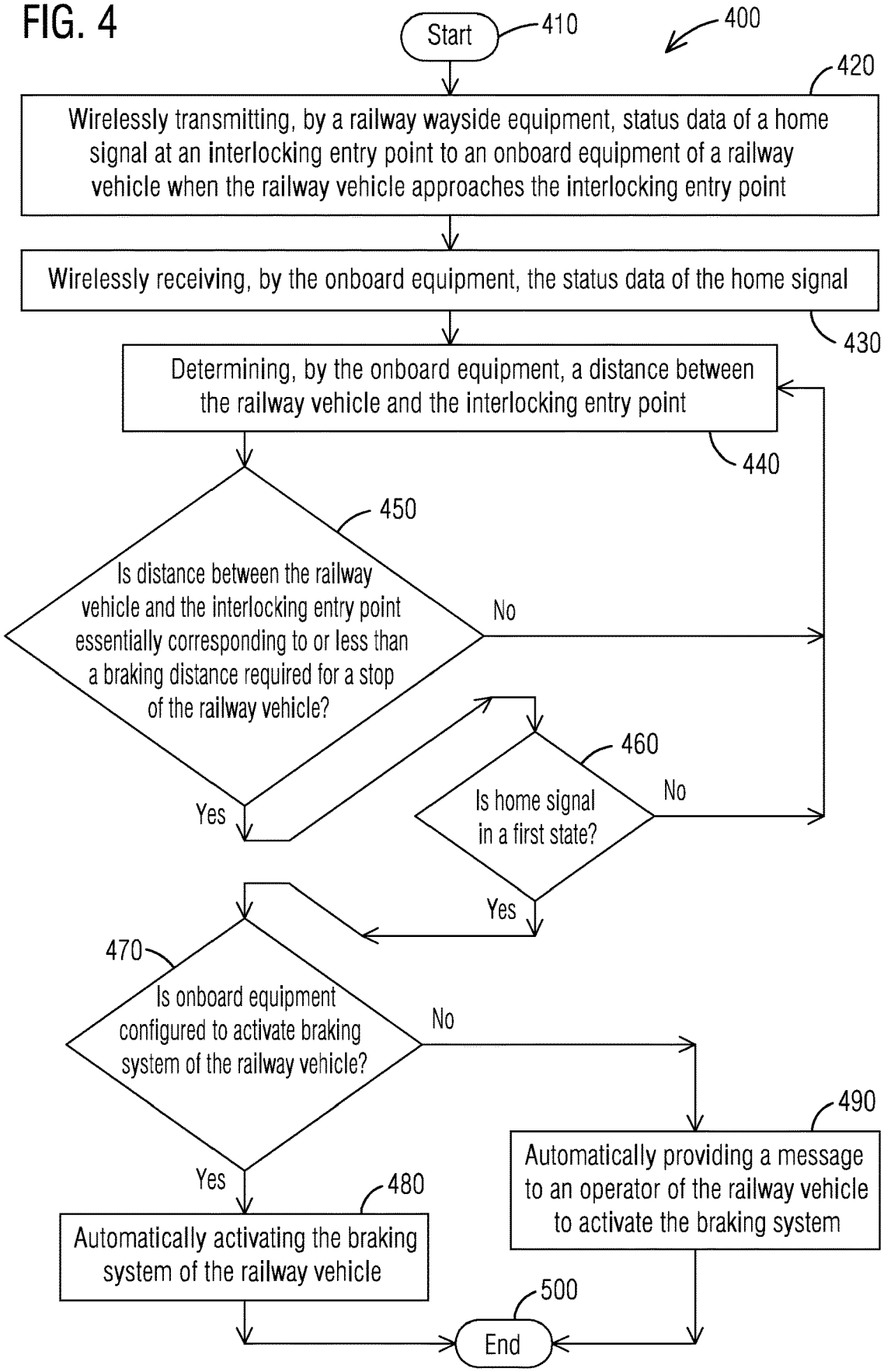
FIG. 4 depicts a flow chart of a train control method in accordance with an exemplary embodiment of the present disclosure.

FIG. 4 depicts a flow chart of a train control method 400. The process or method 400 can be implemented by using any of the features, components, or devices discussed herein, or any combination of them. The method 400 is performed, for example, by a train control system 200 as disclosed herein. While the method 400 is described as a series of acts that are performed in a sequence, it is to be understood that the method 400 may not be limited by the order of the sequence. For instance, unless stated otherwise, some acts may occur in a different order than what is described herein. In addition, in some cases, an act may occur concurrently with another act. Furthermore, in some instances, not all acts may be required to implement a methodology described herein.

The method 400 may start at 410 and may include an act 420 of wirelessly transmitting, by a railway wayside equipment 242, 244, 246, 248, status data of a home signal 202, 204, 206, 208 at an interlocking entry point to an onboard equipment 220, 224 of a railway vehicle 210 when the railway vehicle 210 approaches the interlocking entry point. The method 400 may also include an act 430 of wirelessly receiving, by the onboard equipment 220, 224, the status data of the home signal 202, 204, 206, 208, and an act 440 of determining, by the onboard equipment 220, 224, a distance D between the railway vehicle 210 and the interlocking entry point, e.g., home signal 202, 204, 206, 208.

The method 400 may further comprise a decision act 450, performed by the onboard equipment 220, 224, to determine whether the distance D between the railway vehicle 210 and the interlocking entry point essentially corresponds or is less than a braking distance required for a stop of the railway vehicle 210. If the distance D does correspond or is less than the braking distance required for a stop of the railway vehicle 210, the method 400 will proceed to act 460. If not, then the method 400 will return to act 440.

Act 460 comprises a decision to determine whether the home signal 202, 204, 206, 208 of the respective interlocking entry point(s) is in a first state, the first state corresponding to a stop signal or red signal of the home signal 202, 204, 206, 208. If the home signal 202, 204, 206, 208 comprises a stop signal (red signal), the method proceeds to act 470. If the home signal 202, 204, 206, 208 does not comprise a stop signal, but for example a green signal, the method 400 will return to act 440.

Act 470 comprises a decision to determine whether the onboard equipment 220, 224 is configured to activate the braking system of the railway vehicle 210. If the onboard equipment 220, 224 does have access to the braking system, the onboard equipment 220, 224 will automatically activate the braking system (full service brake or emergency brake) of the train 210, see act 480. If the onboard equipment 220, 224 does not have access to the braking system, the onboard equipment 220, 224 will automatically provide a message to an operator of the train 210 to activate the braking system, see act 490. Acts 450, 460 and 470 are performed by the onboard equipment 220, 224, for example through operation of at least one processor included or integrated in the onboard equipment 220, 224.

At 500, the method 400 may end. It should be appreciated that the described method 400 may include additional acts and/or alternative acts corresponding to features described with respect to the train control system 200, see for example FIG. 2 and FIG. 3.

The home signal 202, 204, 206, 208 or an interlocking 30 is configured to provide the status data/signal data to the wayside equipment 242, 244, 246, 248. For example, the wayside equipment 242, 244, 246, 248 may receive or obtain the relevant data (directly) from the interlocking 30 or from the home signal 202, 204, 206, 208, the home signal 202, 204, 206, 208 receiving status data and instructions to display a specific signal (red signal, green signal etc.) from the interlocking 30.

It should be appreciated that acts associated with the above-described methodologies, features, and functions (other than any described manual acts) may be carried out by one or more data processing systems, via operation of at least one processor. For example, wayside equipment 242, 244, 246, 248 may comprise at least one processor and onboard equipment 220, 224 may comprise at least on processor.

As used herein, a processor corresponds to any electronic device that is configured via hardware circuits, software, and/or firmware to process data. For example, processors described herein may correspond to one or more (or a combination) of a microprocessor, central processing unit (CPU) or any other integrated circuit (IC) or other type of circuit that is capable of processing data in a data processing system.

In addition, it should also be understood that a processor that is described or claimed as being configured to carry out a particular described/claimed process or function may correspond to the combination of the processor with the executable instructions (e.g., software/firmware apps) loaded/installed into a memory (volatile and/or non-volatile), which are currently being executed and/or are available to be executed by the processor to cause the processor to carry out the described/claimed process or function. Thus, a processor that is powered off or is executing other software, but has the described software installed on a data store in operative connection therewith (such as on a hard drive or SSD) in a manner that is setup to be executed by the processor (when started by a user, hardware and/or other software), may also correspond to the described/claimed processor that is configured to carry out the particular processes and functions described/claimed herein.

In addition, it should be understood, that reference to "a processor" may include multiple physical processors or cores that are configures to carry out the functions described herein. Further, it should be appreciated that a data processing system may also be referred to as a controller that is operative to control at least one operation.

With the described train control systems and methods, interlockings are protected without the need for mechanical train stops, approach signals and safe braking distance off-line calculations, which presents significantly less design effort, installation work and eliminates a maximum of field equipment. Capital costs are reduced, and signal systems can be upgraded faster (less design effort and less installation work). Maintenance costs are reduced (less field equipment) and better availability of the control system is provided (less field equipment, i.e. less failures).

Many types of trains and railway vehicles (with or without CBTC functionality) can be (retro)-fitted with the onboard equipment, for example trains without a trip cock, i.e. trains that cannot be stopped by a train stop. The onboard equipment may be provided as an additional feature (add-on) to a CBTC system and may be used as backup for CBTC equipped trains in case of failure of the CBTC equipment.

The invention claimed is:

1. A train control system comprising:

an onboard equipment connected to a railway vehicle and comprising a wireless receiver;

an interlocking controlling railway traffic utilizing interlocking signal equipment, the interlocking comprising solid state interlocking (SSI) or relay-based interlocking, wherein the signal equipment comprises an interlocking entry point and a home signal;

a wayside equipment comprising a wireless transmitter and assigned to the interlocking entry point;

wherein the wayside equipment is configured to wirelessly transmit status data of the home signal to the onboard equipment of the railway vehicle when approaching the interlocking entry point via a wireless communication link, and wherein the onboard equipment is configured to receive the status data of the home signal via the wireless communication link and to determine a distance between the railway vehicle and the interlocking entry point.

2. The train control system of claim 1, wherein the onboard equipment is further configured to automatically activate a braking system of the railway vehicle when the home signal is in a first state and the distance between the railway vehicle and the interlocking entry point essentially corresponds to or is less than a braking distance required for a stop of the railway vehicle.

3. The train control system of claim 2, wherein the first state of the home signal comprises a stop signal.

4. The train control system of claim 3, wherein the onboard equipment is further configured to automatically provide a warning message to an operator of the railway vehicle to activate the braking system of the railway vehicle if the braking system is inaccessible to the onboard equipment.

5. The train control system of claim 1, wherein the wireless communication link utilizes ultra-wide band (UWB).

6. The train control system of claim 1, wherein the interlocking comprises multiple home signals.

7. The train control system of claim 1, wherein the wayside equipment is integrated into a signal head of the home signal.

8. The train control system of claim 1, wherein the onboard equipment comprises a first onboard equipment and a second onboard equipment.

9. The train control system of claim 8, wherein the first and second onboard equipment are each configured to receive the status data of the home signal and to determine the distance between the railway vehicle and the interlocking entry point.

10. A train control method comprising:

wirelessly transmitting, by a railway wayside equipment, status data of a home signal at an interlocking entry point of an interlocking to an onboard equipment of a railway vehicle when the railway vehicle approaches the interlocking entry point;

wirelessly receiving, by the onboard equipment, the status data of the home signal; and determining, by the onboard equipment, a distance between the railway vehicle and the interlocking entry point, wherein the interlocking controls railway traffic utilizing interlocking signal equipment, and wherein the interlocking comprises solid state interlocking (SSI) or relay-based interlocking.

11. The train control method of claim 10, further comprising:

automatically activating, by the onboard equipment, a braking system of the railway vehicle when the home signal comprises a first state and the distance between the railway vehicle and the interlocking entry point essentially corresponds to or is less than a braking distance required for a stop of the railway vehicle.

12. The train control method of claim 10, wherein the first state of the home signal comprises a stop signal.

13. The train control method of claim 12, further comprising:

automatically providing, by the onboard equipment, a warning message to an operator of the railway vehicle to activate a braking system of the railway vehicle if the braking system is inaccessible to the onboard equipment.

14. The train control method of claim 10, wherein the railway wayside equipment and the onboard equipment communicate via a wireless communication link.

15. The train control method of claim 14, wherein the communication link comprises ultra-wide band (UWB).

16. The train control method of claim 10, wherein the home signal or the interlocking is configured to provide the status data to the railway wayside equipment.

17. The train control method of claim 16, wherein the interlocking comprises multiple home signals and interlocking entry points.

18. The train control method of claim 10, wherein the railway wayside equipment is integrated into a signal head of the home signal.

19. The train control method of claim 10, wherein the railway wayside equipment is separate from the home signal arranged outside a signal head of the home signal.

20. The train control method of claim 10, wherein the onboard equipment comprises a first onboard equipment and a second onboard equipment.

* * * * *